US005152091A

United States Patent [19]

Leach

[11] Patent Number: 5,152,091

[45] Date of Patent: Oct. 6, 1992

[54] HIGHWAY SIGN

[76] Inventor: Fred D. Leach, 4308 Buttercup Ave, NE., Salem, Oreg. 97305

[21] Appl. No.: 622,748

[22] Filed: Dec. 5, 1990

[51] Int. Cl.[5] ..... G09F 15/00

[52] U.S. Cl. ..... 40/603; 40/606; 40/610; 40/611; 40/612

[58] Field of Search ..... 40/602, 603, 606, 610, 40/612; 24/580, 163 K, 194

[56] References Cited

U.S. PATENT DOCUMENTS

| | | | |
|---|---|---|---|
| 2,118,135 | 5/1938 | Boldwin | 40/603 |
| 3,899,843 | 8/1975 | Doyle et al. | 40/602 |
| 4,019,271 | 4/1977 | Latimer | 40/603 |
| 4,426,800 | 1/1984 | Brown | 40/610 |
| 4,490,934 | 1/1985 | Knapp | 40/612 |
| 4,592,158 | 6/1986 | Seely | 40/606 |
| 4,619,220 | 10/1986 | Seely et al. | 40/603 |
| 4,888,894 | 12/1989 | Brown, Jr. | 40/602 |
| 4,980,984 | 1/1991 | Kulp et al. | 40/610 |

*Primary Examiner*—Kenneth J. Dorner

*Assistant Examiner*—Cassandra Hope

*Attorney, Agent, or Firm*—Klarquist, Sparkman, Campbell, Leigh & Whinston

[57] ABSTRACT

A collapsible highway sign assembly includes a cross brace assembly having first and second semi-flexible arms pivoted together for pivoting between storage and display positions. Each arm has first and second ends with four fastener stops, each being adjacent one arm end. A sign sheet of a flexible material with opposing message-bearing and attachment faces has four fasteners secured to the attachment face so each slidably receives an arm end and engages the fastener stop adjacent the arm end when the cross brace assembly is in the display position. A pair of flags are pivoted to a first arm upper end with a friction fit. For storage, a flag storage cavity is pivoted between the first and second arms. An anti-kiting device is secured to the sign sheet attachment face and surrounds an arm to resist kiting and maintain the sign assembly in a safe position visible to oncoming motorists. Methods of deploying and preparing the sign assembly for storage are provided.

5 Claims, 6 Drawing Sheets

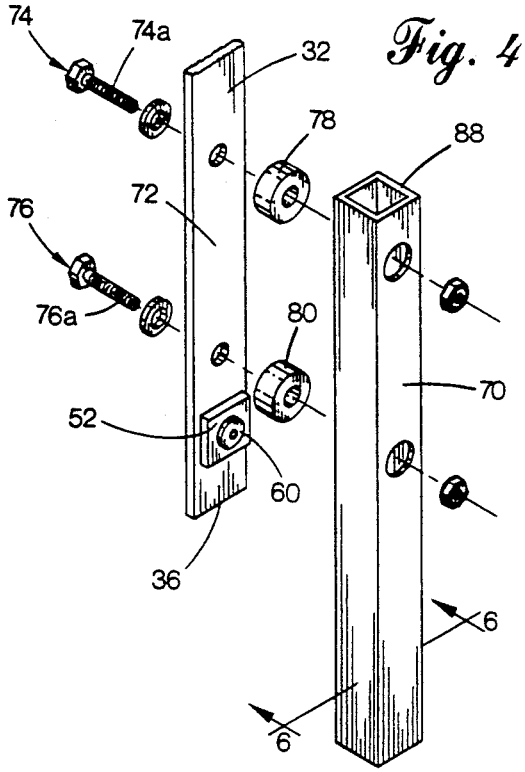
Fig. 4
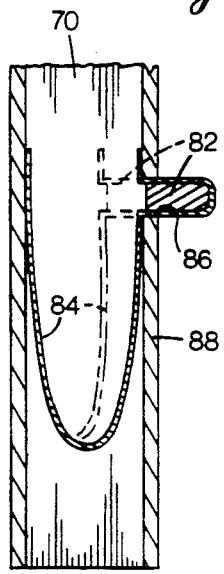
Fig. 6
Fig. 7
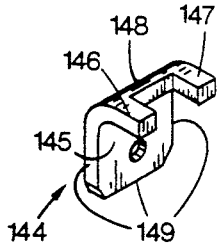
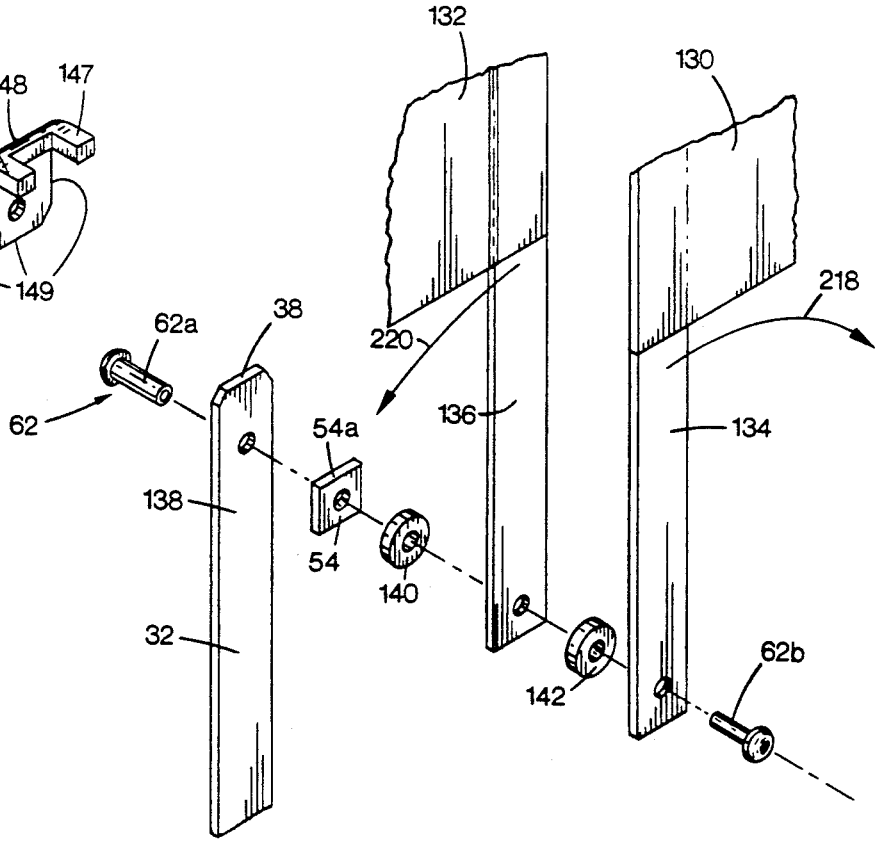
Fig. 5

Fig. 17
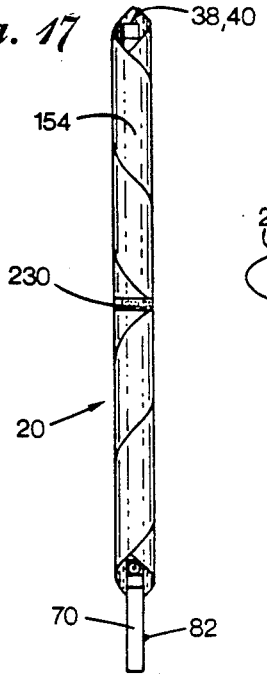
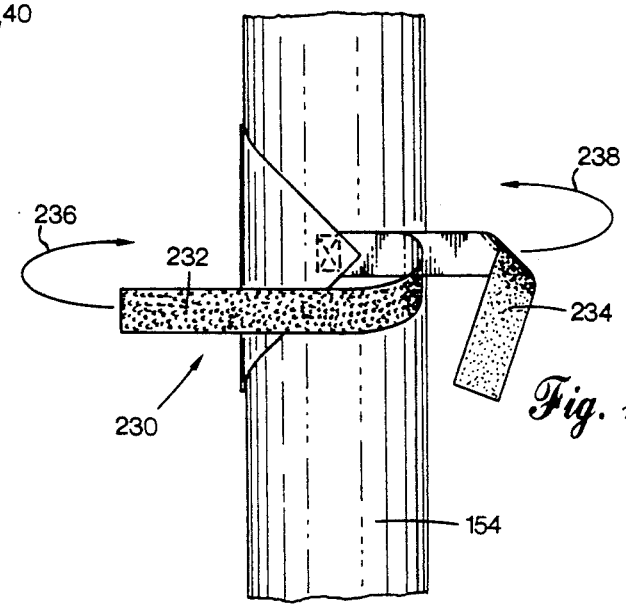
Fig. 18
Fig. 10
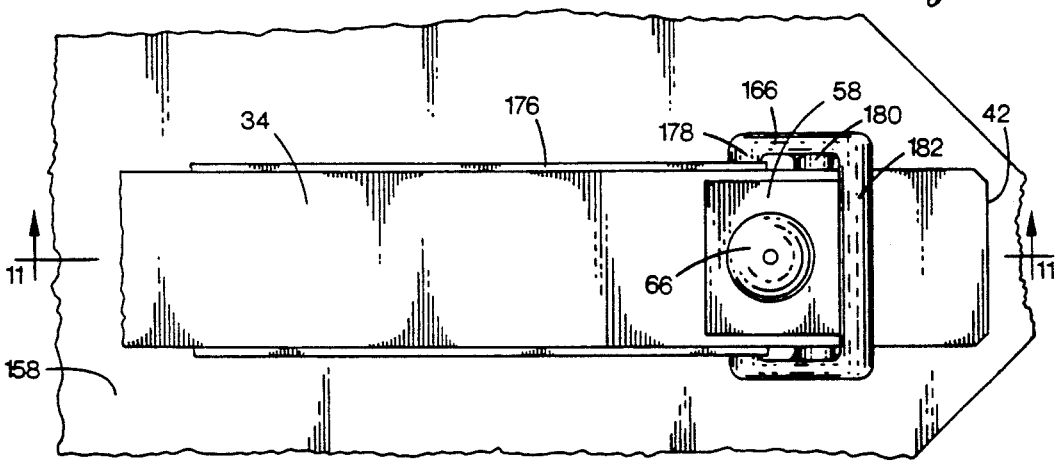
Fig. 11
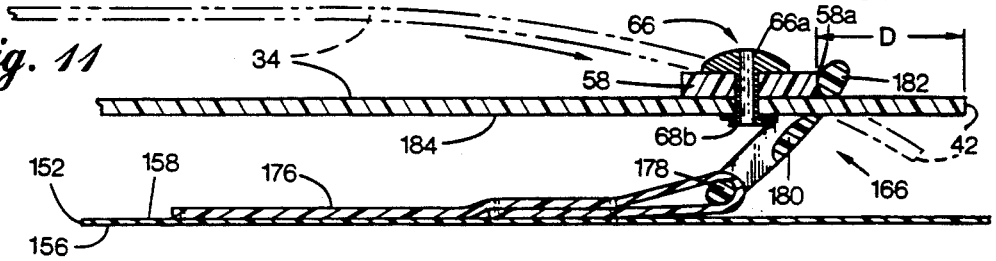

HIGHWAY SIGN

BACKGROUND OF THE INVENTION

The present invention relates generally to a highway sign for temporary use along a roadway, and more particularly to an improved collapsible highway sign assembly and a method for deploying and storing such an assembly, such as may be used to provide warning messages and traffic control directions to motorists during highway construction.

Other collapsible highway sign assemblies have been used in the past to display a legend, such as warning messages and traffic control directions to motorists during road construction and the like. One known system uses a cross brace assembly having two arms pivotally connected together. A flexible sign sheet has a front surface with a message printed thereon and a back surface. The sign sheet includes four pockets on the back surface each for receiving one end of the cross brace arms. To assemble the sign sheet to the cross brace, a first end of one arm is placed in one of the pockets, and this end is then typically placed on the ground or paved roadway. In this position, the arm is then bowed by forcing the first end toward the ground or roadway until the second end is received by a second pocket of the sign sheet. These steps are repeated to attach the remaining two sign sheet pockets to the other arm of the cross brace assembly. This procedure is reversed to remove the sign sheet from the cross brace assembly. Thus, during both assembly and disassembly, two of the sign sheet pockets are disadvantageously subject to abrasive wear between the end of the cross brace arm inserted therein, and the roadway or ground against which the arm is forced during the bending or bowing step.

A typical problem encountered using such known road signs is referred to as "kiting." During this kiting phenomenon, the large surface area of the sign sheet billows when hit by a hard wind. This repeated billowing action causes the ends of the cross brace arms to disadvantageously further wear the sign sheet pockets. Furthermore, extremely strong winds may actually cause some signs to disadvantageously rotate, and no longer be readily visible to oncoming motorists.

To assist in drawing a motorists attention to a highway sign, a pair of flags is typically mounted to the uppermost portion of the upright sign support, with the flags extending upwardly and outwardly away therefrom. It is particularly important that the flags maintain a position above the sign, not only to draw attention to the sign, but to prevent the flags from obscuring any portion of the sign message or legend. Earlier known flag deployment devices included a mechanical lock to secure the flags in their upright display positions. Such mechanical locks and clips are often of metal, and disadvantageously subject to metal fatigue failures from repeated usages. Furthermore, these mechanical flag locking devices often are clogged by ice, dirt and debris, leaving the flags disadvantageously locked in an open position, or unusable if locked in a closed position. When locked in an open position, the extended flag staffs are often subject to damage, during removal, storage or transportation to a new job site.

Thus, a need exists for an improved highway sign, and an improved method of deploying such a highway sign, such as may be used for temporary sign installations associated with road construction and the like, which is directed toward overcoming, and is not susceptible to, the above limitations and disadvantages.

SUMMARY OF THE INVENTION

It is an overall object of the present invention to provide an improved collapsible highway sign assembly.

A further object of the present invention is to provide an improved collapsible highway sign assembly which is durable and withstands weathering by the elements, including the wind.

A further object of the present invention is to provide an improved collapsible and portable highway sign assembly which may be used repeatedly at different display locations.

An additional object of the present invention is to provide a highway sign assembly which enhances both motorists and construction worker safety.

Another object of the present invention is to provide an improved cross brace assembly for use with a variety of sign sheet assemblies bearing differing legends.

A further object of the present invention is to provide an improved flag deployment system for storing and displaying flags on a collapsible highway sign assembly.

Still another object of the present invention is to provide an improved sign sheet assembly with enhanced wear characteristics which may be used with a cross brace assembly for display as a highway sign.

Yet another object of the present invention is to provide an improved method of deploying, and preparing for storage, a collapsible highway sign.

According to one aspect of the present invention, a collapsible highway sign assembly is provided for displaying a message to motorists traversing a highway along which the sign assembly is located. The collapsible highway sign assembly includes a cross brace assembly having first and second semi-flexible arms pivoted together for pivoting between storage and display positions. Each arm has first and second ends with four fastener stops, each being adjacent one arm end. A sign sheet of a flexible material with opposing message-bearing and attachment faces has four fasteners secured to the attachment face so each slidably receives an arm end and engages the fastener stop adjacent the arm end when the cross brace assembly is in the display position. A pair of flags are pivoted to a first arm upper end with a friction fit. For storage, a flag storage cavity is provided between the first and second arms. An anti-kiting device is secured to the sign sheet attachment face and surrounds an arm to resist kiting and maintain the sign assembly in a safe position visible to oncoming motorists. Methods of deploying and preparing the sign assembly for storage are provided. A cross brace assembly and a sign sheet assembly are also provided.

The illustrated embodiment of the highway sign assembly also includes a pair of flags pivotally secured by a friction fit to the upper end of the first arm. The first and second arms are pivoted together at a spaced-apart distance, to provide a flag storage cavity therebetween when the arms are in the storage position. The flags are pivoted into the flag storage cavity for protection during storage. Additionally, the highway sign assembly may include a flag lock or position bracket to secure the flags in a display position. The sign sheet assembly may also include a securing strap attached to one edge thereof. When the cross brace arms are in the storage position, the sign sheet may be rolled around the cross brace assembly and surrounded by the securing strap to secure the sign assembly in the storage position.

The present invention relates to the above features and objects individually as well as collectively. These and other objects, features and advantages of the present invention will become apparent to those skilled in the art from the following description and drawings.

BRIEF DESCRIPTION OF THE DRAWINGS

FIG. 4 is an enlarged exploded perspective view of a portion of the highway sign assembly shown in FIG. 2;

FIG. 5 is an enlarged exploded perspective view of a portion of the highway sign assembly shown in FIG. 2;

FIG. 6 is a vertical sectional view taken along line 6—6 of FIG. 4;

FIG. 7 is an enlarged perspective view of one form of flag lock or bracket in accordance with the present invention;

FIG. 10 is an enlarged elevational view of a portion of the highway sign assembly of FIG. 2;

FIG. 11 is a horizontal sectional view taken along line 11—11 of FIG. 10;

FIGS. 14 through 18 illustrate a method in accordance with the present invention of preparing one form of a highway sign assembly of the present invention for storage, as well as in the reverse, illustrating a method in accordance with the present invention of deploying this form of a highway sign assembly of the present invention.

DETAILED DESCRIPTION OF A PREFERRED EMBODIMENT

Figure 1:
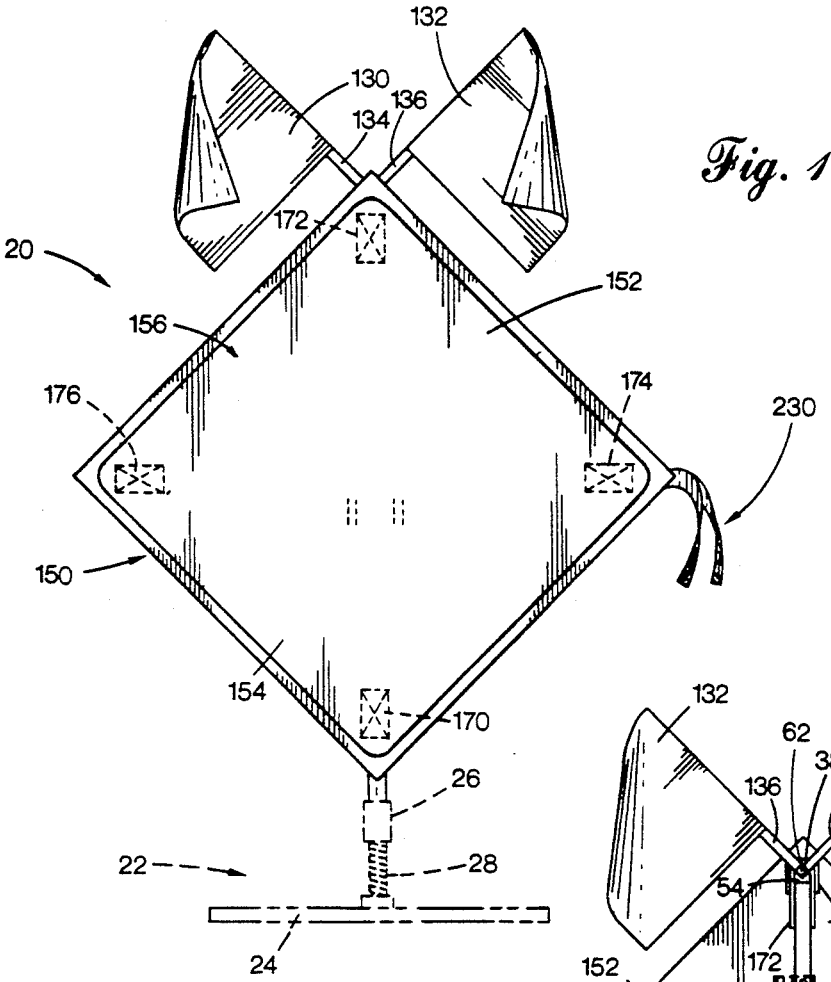
FIG. 1 is a front elevational view of one form of an erected collapsible highway sign assembly of the present invention.
Figure 2:
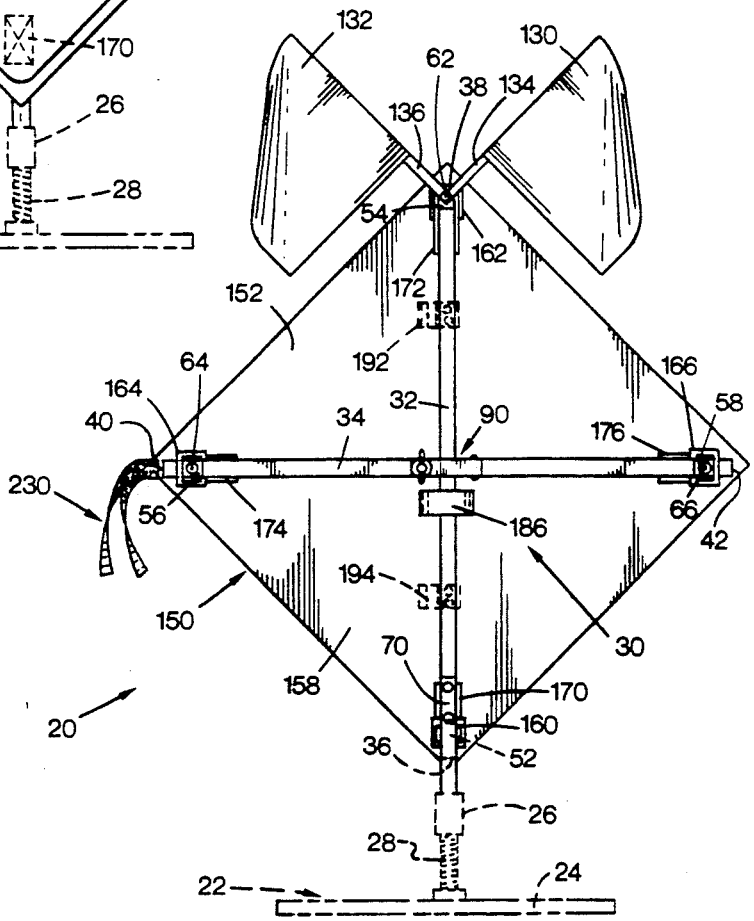
FIG. 2 is a rear elevational view of the sign assembly of FIG. 1.
Figure 3:
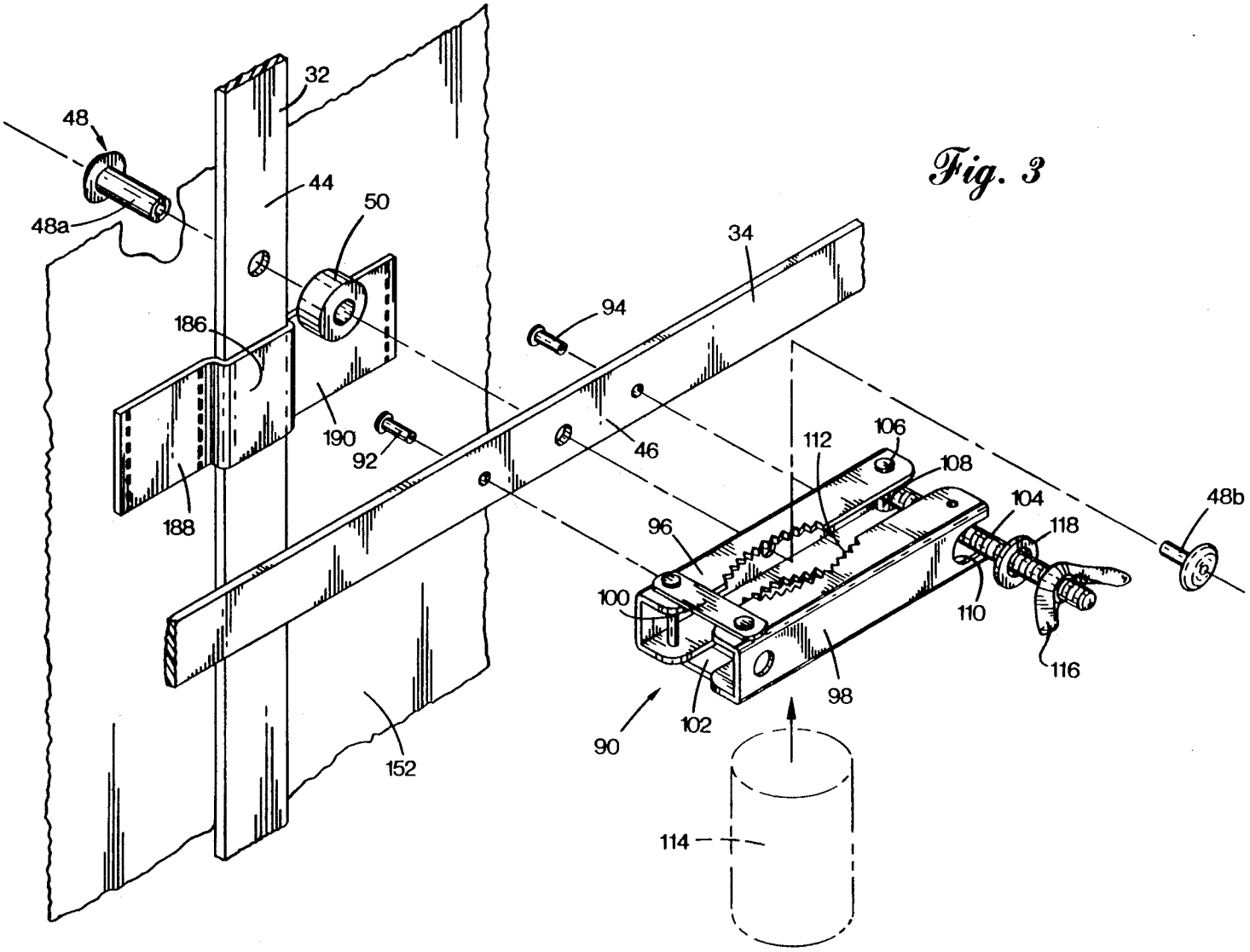
FIG. 3 is an enlarged exploded perspective view of a portion of the highway sign assembly shown in FIG. 2.

FIGS. 1 and 2 illustrate an embodiment of a collapsible highway sign assembly 20 constructed in accordance with the present invention for use with a ground-engaging stand, such as stand 22. The stand 22 includes a base 24, and an upwardly extending hollow stub-shaft 26 which is resiliently attached to the base 24 by spring shaft 28. Referring also to FIG. 3, the sign assembly 20 includes a cross brace assembly 30 having an upright or vertical first arm 32 and a horizontal or lateral second arm 34 each of which is substantially rigid, but semi-flexible for reasons to become apparent. The vertical arm 32 has first and second ends 36, 38 (also see FIGS. 4 and 5), and the horizontal arm 34 has first and second ends 42, 40. The first and second arm ends have been arbitrarily assigned to assist in this discussion of the invention, and it is apparent that the first and second end designations for each arm are interchangeable.

The arms 32, 34 may be of a fiberglass reinforced plastic (FRP) or other composite or noncomposite material having elastic flexure properties which advantageously allow the arms 32 and 34 to bend slightly. This feature assists in assembling the sign assembly 20 as described further below. Additionally, this feature advantageously allows the sign assembly 20 to flex and yield to wind loads, and thereby off-load wind from the sign assembly.

Referring now to FIG. 3, the arms 32, 34 have respective central portions 44, 46. The arm central portions 44 and 46 are pivoted together by an arm pivot pin member, such as rivet 48 having female and male portions **48*a* and 48*b*, respectively. With the arms 32, 34 pivoted together, they may be pivoted (see FIG. 14) between a display position as shown in FIG. 2 and a storage position (see FIG. 17). For example, the arms 32 and 34 may be spaced-apart about $\frac{5}{8}$ or $\frac{3}{4}$ inch, with this spacing established by an arm spacer 50 mounted therebetween on rivet 48**.

To provide for some degree of control when pivoting the arms 32 and 34, it may be advantageous to have these arms secured together by a friction fit. Such a friction fit may be obtained by providing an arm spacer 50 of a resilient material, such as of a polyurethane, in combination with coordinating the thicknesses of arms 32, 34 and spacer 50 with the length of the rivet 48. A friction fit advantageously aids in preventing pinched fingers during disassembly of the sign assembly 20 as an operator rotates the arms 32, 34 by hand into a mutually parallel position (see FIGS. 14 and 15).

Referring to FIG. 2, adjacent each arm end 36, 38, 40 and 42 is a first engaging member, such as a stop lug or fastener stop 52 (see FIG. 4), 54, 56 and 58, respectively, attached thereto by the respective rivets 60 (see FIG. 4), 62, 64 and 66. The fastener stop may be of an ABS plastic or of other materials. A washer (not shown) may be inserted between the fastener stop and rivet head. The first engaging members may take on other configurations, as will be apparent to those skilled in the art.

The highway sign assembly 20 also includes a stand receiver, shown in FIGS. 4 and 6 mounted on the lower end of arm 32, with the stand receiver being of a type which receives the stub shaft 26 of a ground-engaging stand. For example, a rectangular tubular member 70 is attached to lower end 72 of arm 32 by two fastener assemblies 74, 76 each comprising a bolt, washer and nut. To provide access to the fastener stop 52, the tubular member 70 is mounted to the upright arm 32 at a spaced-apart distance, provided by spacers 78, 80 mounted on the respective bolts **74*a* and 76*a*. The tubular member 70 is adapted to be inserted into a cooperatively formed rectangular central opening in the stub shaft 26**.

Referring now to FIG. 6, to aid in securing the sign assembly 20 to the stand 22, the tubular member 70 includes a securing device, such as a spring-loaded detent pin 82. The detent pin 82 is biased by a spring member 84 to extend outwardly through a hole 86 provided within wall 88 of tubular member 70. The detent pin 82 engages a corresponding hole (not shown) within the hollow stub-shaft 26 of the stand 22.

Referring again to FIG. 3, an alternate stand receiver is illustrated comprising a universal clamp member 90. The clamp 90 is attached to the central portion 46 of horizontal arm 34 by fasteners, such as rivets 92 and 94, as well as by rivet 48. The clamp 90 has two jaw members 96, 98 which are pivotally joined together at one end by links 100, 102. At the opposite end, jaw member 96 has a threaded member 104 pivoted thereto by pin 106. To provide a controlled pivotal motion of the threaded member 104 about pin 106, member 104 is flanked by two resilient spacers, such as spacer 108, each mounted on pin 1 06. Jaw member 98 has a slot 110 which receives the threaded member 104.

The jaw members 96 and 98 each have serrated, roughly semi-circular jaw portions, such as 112, which grip post 114 extending from a ground-engaging stand. Advantageously, the jaw portions such as 112 may grip a variety of different cross-sectionally shaped posts, such as T-shaped posts or rectangular posts (not shown). It is apparent that the ground-engaging stand may advantageously be a permanently installed stand, such as a buried post, to which the sign assembly 20 may be attached using clamp 90. Thus, the threaded member 104 may be pivoted out of engagement with slot 110 to allow jaw member 98 to be opened to surround post 114. The jaw member 198 may then be closed around post 114 and threaded member 104 pivoted back into engagement with slot 110. The sign assembly 20 is then secured to post 114 by tightening a wingnut 116 against a washer 118 into engagement with jaw member 98. Note that the illustrated sign assembly advantageously includes both the stub-shaft engaging member 170 and the clamp 90, which allows sign 20 to be used with a stand 22 having a hollow stub-shaft, or with a stand having an upright post 114.

Referring to FIG. 5, the cross brace assembly 30 may also include at least one flag 130, and preferably a pair of flags 130, 132. The flags advantageously draw an oncoming motorist's attention to the sign assembly 20. The flags 130, 132 may be of any type of flexible material, such as of a nylon vinyl scrim which is both weather resistant and durable. The flags 130, 132 each have respective flag staffs 134 and 136. The flag staffs 134, 136 are pivoted to an upper end 138 of arm 32 by a flag pivot pin member, which advantageously may be the rivet 62 which has female and male portions **62*a* and 62*b***.

The flags 130, 132 may be advantageously mounted to the arm 32 with a friction fit. This friction fit may be accomplished by assembling a resilient spacer 140 between the fastener stop 54 and flag staff 136 and a resilient spacer 142 between the flag staffs 134 and 136. The spacers 140, 142 may be of any type of resilient material, such as of a polyurethane or polypropylene. The friction fit may be obtained by coordinating the selection of the thicknesses of arm 32, fastener stop 54, spacers 140, 142 and flag staffs 134, 136 with the length of the rivet 62. By slightly compressing the spacers 140, 142 the flags may be rotated by hand into a desired position, and held therein by the friction fit. Furthermore, spacer 140 advantageously provides for clearance between the fastener stop 54 and flag staff 136 for access to stop 54. The spacers 140, 142 also advantageously reduce wear of the flag staffs 134, 136 and are non-corroding as opposed to previous metallic spacers, if any, used by others.

Figure 9:
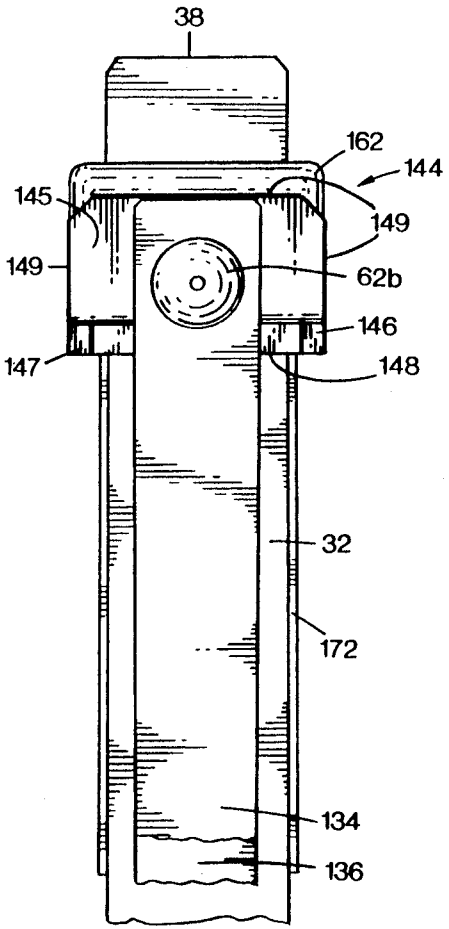
FIG. 9 is an enlarged rear elevational view of the assembly of FIG. 8, with the flag assembly shown in a storage position.
Figure 8:
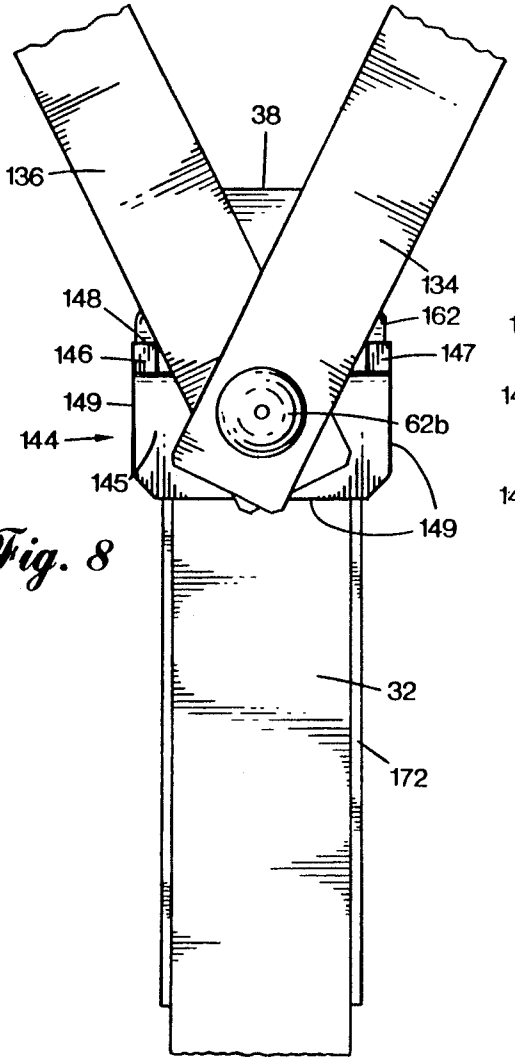
FIG. 8 is an enlarged rear elevational view of one form of a portion of the highway sign assembly of the present invention including the flag lock of FIG. 7, with the flag assembly shown in a display position.

Referring to FIGS. 7–9, to assist the friction fit of the flags 130, 132 or in lieu thereof, a flag positioning device, such as flag lock or positioning bracket 144 may be provided. The flag lock 144 may be of any type of substantially rigid material, such as ABS. The flag lock 114 has a body portion 145 which is pivoted to arm 32 by the flag pivot pin rivet 62. The flag lock 144 is pivotable between a display position shown in FIG. 8, and a storage position shown in FIG. 9. Two arms 146 and 147 project outwardly from the body portion 145 in a direction away from arm 32. The arms 146 and 147 define therebetween a flag locating region through which the flag staffs 134, 36 extend. Referring to the display position of FIG. 8, flag 134 rests against arm 147, and flag 136 rests against arm 146.

In the illustrated embodiment, the flag bracket 144 advantageously serves as the first engaging member adjacent end 38, advantageously replacing the fastener stop 54. To accomplish this, the pivotable bracket 144 includes a shoulder 14S and a side surface 149. As the bracket is pivoted between display and storage positions (see FIGS. 8 and 9), the shoulder 148 and side surface 149 alternatively serve as an engagement face which substitutes for the engagement face **54*a* on fastener stop 54 (see FIG. 5**).

Referring again to FIGS. 1 and 2, the collapsible highway sign assembly 20 includes a sign sheet assembly 150 having a sign sheet or sign tarp 152 of a flexible material, which may be a reflective, a nonreflective or a woven mesh material. A suitable reflective material is sold under the trademark "REFLEXITE;" a suitable nonreflective material is sold under the trademark "WEBLON;" and a suitable woven mesh is sold under the trademark "TEXTILENE." The sign sheet 152 has a message-bearing face or front surface 154 which may have a sign legend 156 imprinted thereon (see FIG. 1).

Opposing the message-bearing front face 154, the sign sheet 152 has an attachment face or back surface 158. Four second engaging members, such as fastener slides or buckle members 160, 162, 164 and 166 are attached to the attachment face 158 for engaging the first engaging members or stops 52, 54, 56 and 58. The fasteners 160, 162, 164 and 166 in the illustrated embodiment are tethered to the attachment face 158 by straps 170, 172, 174 and 176, respectively.

The first and second engaging members described herein are but one illustration of suitable interengaging means for interconnecting the sheet assembly 150 with the cross brace assembly 30. The configuration of the first engaging members is coordinated with the configuration of the second engaging members, each of which may have a variety of configurations. Upon interengagement of the interengaging means, at least one end of each arm 32, 34 is left exposed and uncovered by the sign sheet 52 during assembly and disassembly. This feature advantageously prevents the sign sheet fabric from becoming worn, particularly during assembly and disassembly. For example, substituting flag lock or bracket 144 for stop 54, the rounded shoulder portion 148 of the flag lock serves to engage the fastener 162 when bracket 144 is in a display position. When bracket 144 is rotated into the storage position, the edge or side surface 149 serves as the fastener stop and engages the fastener 162.

The engagement of the first and second engaging members is illustrated by way of example in FIGS. 10 and 11 showing the fastener 166 engaging the fastener stop 58. In the illustrated example, the fastener 166 is a buckle which may be obtained from Nexus Manufacturing Inc., of Wood Dale, Ill. 60191 under the trademark of "TRIGLIDE", Part No. 1050. The fastener 166 includes a mounting bar member 178 which is looped by strap 176 to tether the fastener 166 to attachment face 158. The fastener also includes an intermediate cross member 180 and a distal cross member 182, between which the end 42 of arm 34 is inserted.

The fastener distal cross member 182 engages the fastener stop 58, and the intermediate bar member 180 engages a forward facing surface 184 of arm 34. The fasteners 160, 162, 164 and 166 are located on the sign sheet attachment face 158 so that when engaged with the fastener stops 52, 54, 56 and 58, respectively, the sign sheet 152 is in tension and the arms 132 and 134 may be slightly bowed or in compression. For example, the fasteners 164 and 166 are located on sheet face 158 so that the distance between their respective distal cross members 182 is less than the distance between the outboard edges (such as edge 58*a* in FIG. 11) of fastener stops 56 and 58 along arm 34.

The degree of tension or compression may vary depending upon the environmental conditions. To assure engagement of the fasteners and fastener stops is maintained during use, the fastener stops, such as 58 may be spaced from the arm end, such as end 42, a predetermined distance, such as between ¾ and 1½ inches, preferably around one inch, as indicated by distance D in FIG. 11. It is apparent that when other interengagement devices or interengaging means are used, the predetermined distance may vary accordingly. For example, with some interengagement devices, a portion of the first engaging means may be substantially flush with an arm end (i.e., a predetermined distance of zero), and the arm end may still be exposed and uncovered by the sign sheet 152.

Referring again to FIG. 2, the sign sheet assembly 150 may further include anti-kiting devices, such as a fabric strap keeper 186. The anti-kiting keeper 186 has two ends 188, 190 secured to the sign sheet attachment face 158, for example by stitching. In this manner, the keeper 186 forms a loop for slidably receiving arm 32 between the keeper and the attachment face. The anti-kiting device advantageously prevents the sign sheet 150 from billowing away from the cross brace assembly 30 during windy conditions. Thus, the anti-kiting device 186 in combination with the semi-flexible arms 32, 34 allows the sign assembly 20 to flex and bend during heavy wind conditions, so the sign assembly may off-load the wind.

One anti-kiting device such as keeper 186 has proven advantageous for smaller signs, such as those having sign sheets 152 thirty-six inches square, with the preferred location being near a central region of the sign sheet 152. For larger signs, such as those having sign sheets 152 forty-eight inches square, it has proven advantageous to use two anti-kiting devices 192 and 194, with one above and one below the horizontal arm 34, as shown in dashed lines in FIG. 2.

Figure 12:
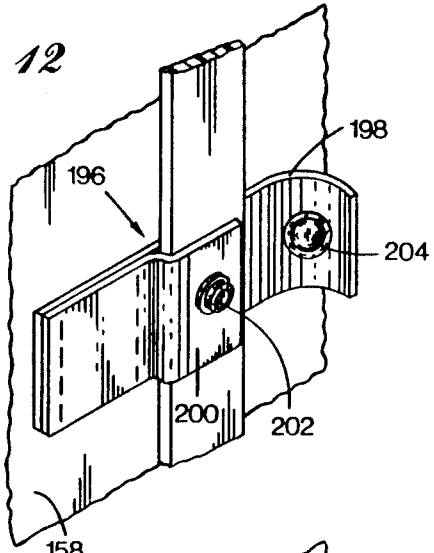
FIG. 12 is a detailed view of one form of an alternate embodiment of an anti-kiting device in accordance with the present invention.
Figure 13:
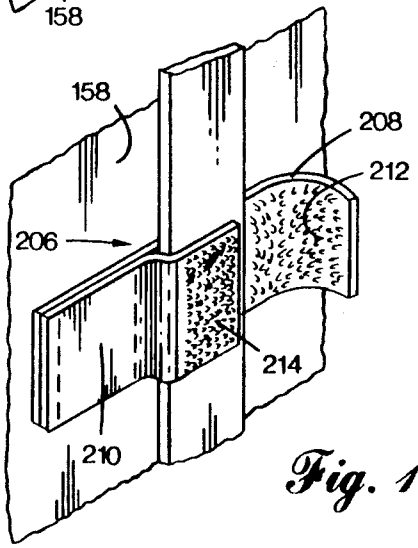
FIG. 13 is a detailed view of an alternate embodiment of an anti-kiting device in accordance with the present invention.
Figures 14, 15, 16:
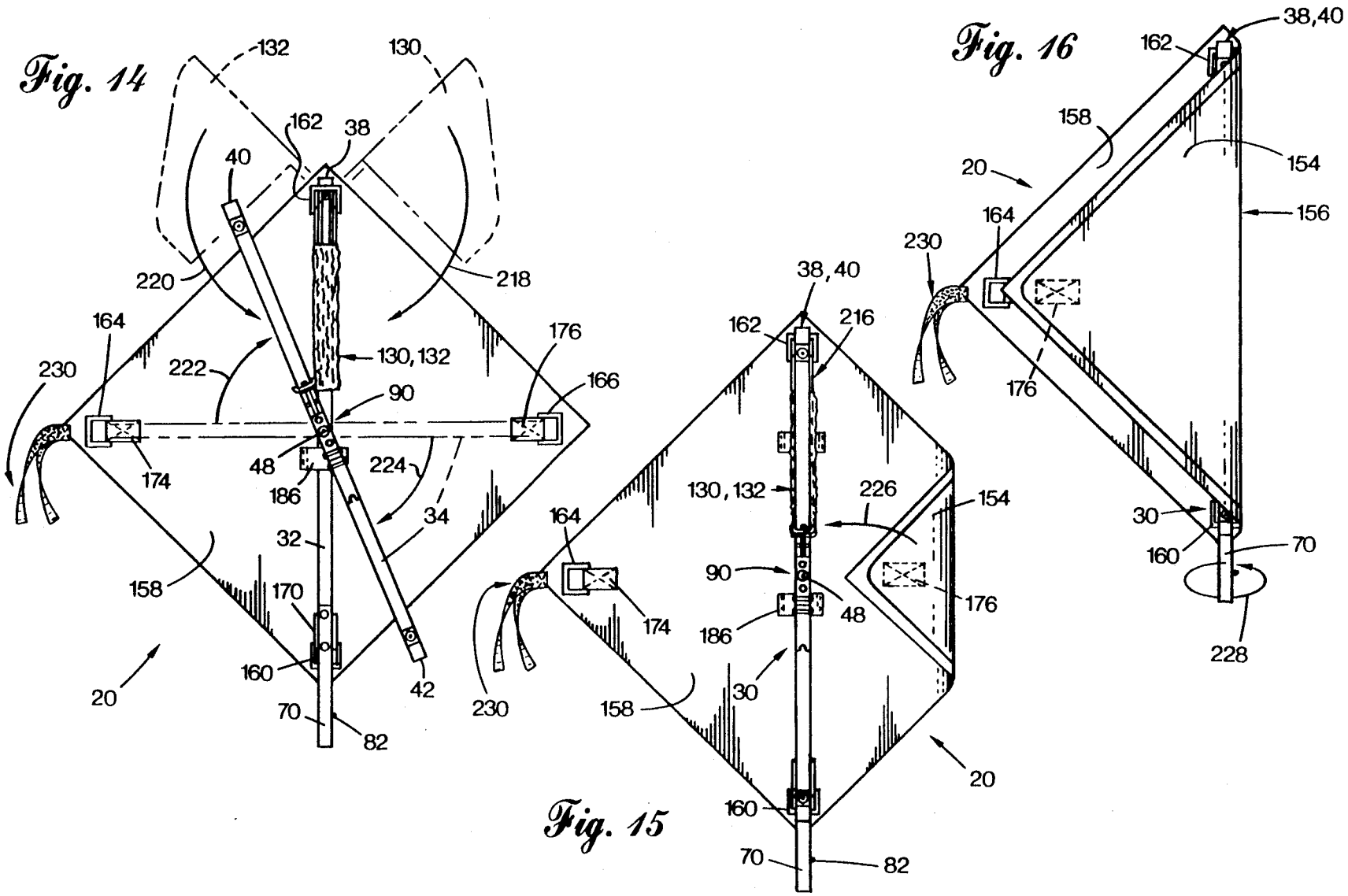

An alternate anti-kiting device 196 is shown in FIG. 12 as having a fastener of a type which allows device 196 to detachably surround a cross brace arm. This detachable anti-kiting device 196 includes first and second straps 198, 200 secured to the attachment face 158, for example, by stitching. The first and second straps 198, 200 are interconnectable by a fastener comprising snap means, such as a snap assembly comprising male and female snap portions 202 and 204, respectively. It is apparent that more than one snap assembly may be used to enhance the reliability of the sign assembly 20. An alternate detachable anti-kiting device 206 is shown in FIG. 15, as having straps 208 and 210. The straps 208, 210 may be fastened together by a fastener comprising respective hook and loop fabric fasteners 212, 214, such as that sold under the trademark VELCRO.

With reference to FIGS. 3, 5, 14 and 15 it can be seen that the inclusion of arm spacer 50 provides a spaced-apart region between arms 32 and 34 when pivoted to a parallel storage position to define a flag storage cavity 216 between the arms. For example, an arm spacer 50 of about ¾ inches in length provides a suitable flag storage cavity 216. To store the flags 130 and 132, they are rolled around the respective erected flag staffs 134, 136 which are then pivoted downwardly in the direction indicated by arrows 218, 220 into a position substantially parallel with arm 32. Alternatively the flag staffs 134, 136 may be aligned substantially parallel to one another, and the flags 130, 132 rolled around the aligned staffs, and then the staffs may be rotated in unison into cavity 216. If the flag position bracket 144 is used, the flag bracket 144 is also rotated with the flags, such that the bracket arms 146, 147 are positioned in a more-protected location deeper within the interior of cavity 216. Thus, the flags are protected between the arms during storage and transportation.

In operation, the sign assembly 20 may be removed from the display position shown in FIG. 2 and prepared for storage as illustrated by FIGS. 14–18. It is apparent that these steps may be reversed to provide a method for deploying the sign assembly 20 from a storage position of FIG. 17, into the display position of FIG. 2. Thus, FIGS. 2 and 14–18 will also be used to illustrate a method of removing the sign assembly 20 and preparing it for transport and storage.

The sign assembly stand receiver comprising the stub-shaft engaging member 70 is removed from the stub-shaft hollow upright 26 by first pressing detent pin 82 inwardly to the dashed position shown in FIG. 6, and out of engagement with a hole (not shown) through upright 26. The sign assembly 20 is then lifted out of the upright 26. If the clamp stand receiver 90 is used, wing-nut 116 is first loosened. This allows threaded member 104 to be pivoted out of engagement with slot 110, so jaw member 98 may swing open to release post 114.

The horizontal arm 34 is disengaged at each end from the sign sheet assembly 150. This is accomplished by placing either arm end 40 or 42 against a support surface, such as an asphalt or concrete road surface or a truck bumper. The arm 34 is flexed or bowed (see dashed lines in FIG. 11) by forcing arm 34 toward the support surface until the opposite end of the arm may be disengaged from the corresponding fastener. This substantially relieves a portion of the tension within the sign sheet 152, allowing the fastener that was adjacent the support surface during the bowing step to be slipped over the end of arm 34. As shown in FIG. 14, the arm 34 is then pivoted as shown by arrows 222 and 224, from the dashed position into a storage position substantially parallel with arm 32.

As shown in FIG. 15, the sign sheet 152 may then be doubled over onto itself, as indicated by arrow 226, to the position shown in FIG. 16 to protect the cross brace assembly 30. Then, the sign may be rolled up in the direction indicated by arrow 228 in FIG. 16 until it is in a storage position, as a rolled-up sign assembly shown in FIG. 17. To secure the sign assembly 20 in the storage position, a securing strap 230 may be included. The securing strap 230 may be attached to the sign sheet 152 adjacent one of the ends 40 or 42 of arm 34, as shown in FIG. 2. As shown in FIG. 18, the illustrated securing strap 230 comprises two strap portions 232, 234, illustrated as respective hook and loop fabric fastener means, such as that sold under the trademark VELCRO. The straps 232 and 234 surround the rolled up sign as indicated by the respective arrows 236 and 238 to secure the sign assembly 20 in the rolled up storage position of FIG. 17.

The present invention has many advantages, some of which are mentioned above. Furthermore, the cross brace assembly 30 may be removed or replaced from the sign sheet assembly 150 and the stand 22 without requiring tools or hardware replacement. The first and second engagement members 52, 54, 56, 58, and 160, 162, 166, 164, respectively, when engaged allow the arm end adjacent the first engagement member to remain exposed and uncovered by the sign sheet 152, eliminating sign sheet wear experienced with previous pocketed sign sheets during field assembly, disassembly and display. The simple and rapid deployment and preparation for storage of sign assembly 20 saves labor time. The compact, neat storage package provided by the sign assembly 20 shown in FIG. 14 protects the sign assembly during transportation between job sites, as well as during storage. Additionally, manufacturing the sign assembly 20 of substantially insulative or non-electrically conducting materials provides a sign assembly which is particularly useful to electrical utilities. Additionally, such a sign assembly has enhanced resistance to corrosion from the elements, such as rain, salt spray and the like.

Having illustrated and described the principles of my invention with respect to a preferred embodiment, it should be apparent to those skilled in the art that my invention may be modified in arrangement and detail without departing from such principles. For example, other interengagement means comprising the first and second engagement means may be employed, such as rings or hook members, as well as suitable material substitutions and dimensional variations for the components of the sign assembly 20. I claim all such modifications falling within the scope and spirit of the following claims.

I claim:

1. A collapsible highway sign assembly, comprising:

a cross brace assembly having first and second substantially rigid yet semi-flexible arms pivoted together at a central portion of each arm for pivotable movement between storage and display positions, each arm having first and second ends;

a sign sheet assembly having a sign sheet of a flexible material with opposing message-bearing and attachment faces; and plural interengaging devices each comprising first and second engaging members with the first engaging members supported by the cross brace assembly and the second engaging members supported by the sign sheet assembly, with the first and second engaging members arranged so as to allow one end of each arm to remain exposed and uncovered by the sign sheet when each of the interengaging devices are engaged and the cross brace is in the display position;

wherein the first engaging members comprise four fastener stops, each located a predetermined distance from an arm end; and wherein second engaging members comprise four fasteners each having an opening therethrough and each tethered to the sign sheet attachment face at a location to receive therethrough and capture one of the arm ends so as to engage the fastener stop located adjacent said arm end.

2. A collapsible highway sign assembly according to claim 1 wherein:

when in the display position, the first arm has an upper end;

the assembly further includes a pair of flags pivotally attached to the first arm upper end; and the first arm is adjacent the sign sheet, and the second arm is pivoted to the first arm at a spaced-apart distance from the first arm so as to provide a flag storage cavity between the first and second arms when pivoted into the storage position, whereby the pair of flags may be pivoted into a storage position in the flag storage cavity.

3. A collapsible highway sign assembly, comprising:

a cross brace assembly having first and second substantially rigid, semi-flexible arms pivoted together at a central portion of each arm, the arms pivotable between storage and display positions, each arm having first and second ends with a first engaging member adjacent each arm end; and a sign sheet assembly having a sign sheet of a flexible material with opposing message-bearing and attachment faces, the sign sheet assembly having four second engaging members each located on the attachment face to engage one of the first engaging members when the cross brace assembly is in the display position so as to place the sign sheet in tension when each second engaging member engages one of the first engaging members, with at least one end of each arm being exposed when the first and second engaging members are engaged;

wherein each second engaging member comprises a fastener including a buckle member which is tethered to the sign sheet attachment face.

4. A collapsible highway sign assembly according to claim 3, wherein:

the first engaging member adjacent the first end of each arm comprises a fastener stop located a predetermined distance from the first end; and each fastener located to engage the first engaging members adjacent the first end of each arm has an opening therethrough to receive the arm first end to capture the arm and engage the fastener stop adjacent the first end.

5. A collapsible highway sign assembly according to claim 3, wherein:

each of the first engaging members comprises a fastener stop located a predetermined distance from the respective adjacent arm end; and each fastener slidably receives the arm adjacent the arm end and engages the fastener stop.

* * * * *